US005983874A

United States Patent [19]

Suzuki et al.

[11] Patent Number: 5,983,874

[45] Date of Patent: Nov. 16, 1999

[54] AIR-FUEL RATIO CONTROL SYSTEM FOR INTERNAL COMBUSTION ENGINES

[75] Inventors: Norio Suzuki; Kouichi Saiki; Hiroki Munakata, all of Wako, Japan

[73] Assignee: Honda Giken Kogyo Kabushiki Kaisha, Tokyo, Japan

[21] Appl. No.: 09/134,523

[22] Filed: Aug. 14, 1998

[30] Foreign Application Priority Data

Aug. 20, 1997 [JP] Japan ..... 9-237876

[51] Int. Cl.[6] ..... F02M 25/00

[52] U.S. Cl. ..... 123/673; 123/677; 123/682

[58] Field of Search ..... 123/673, 677, 123/682; 701/109

[56] References Cited

U.S. PATENT DOCUMENTS

| | | | |
|---|---|---|---|
| 5,524,599 | 6/1996 | Kong et al. | 123/682 |
| 5,657,736 | 8/1997 | Maki et al. | 123/673 |
| 5,806,506 | 9/1998 | Kitamura et al. | 123/673 |
| 5,813,389 | 9/1998 | Kitamura et al. | 123/673 |
| 5,911,682 | 6/1999 | Kato et al. | 123/673 |

FOREIGN PATENT DOCUMENTS 6-173755 6/1994 Japan .

*Primary Examiner*—John Kwon

*Attorney, Agent, or Firm*—Nikaido, Marmelstein, Murray & Oram LLP

[57] ABSTRACT

An air-fuel ratio control system for an internal combustion engine includes an air-fuel ratio sensor arranged in the exhaust system of the engine. An ECU estimates the air-fuel ratio of a mixture supplied to each of the cylinders cylinder by cylinder in response to an output from the air-fuel ratio sensor, by using an observer for observing an internal operative state of the exhaust system, based on a model representative of the behavior of the exhaust system, and calculates cylinder-by-cylinder air-fuel ratio control amounts corresponding respectively to the cylinders for carrying out feedback control of the air-fuel ratio of the mixture supplied to each of the cylinders such that the estimated air-fuel ratio of the mixture supplied to each of the cylinders is converged to a desired value. Upper and lower limit values of the cylinder-by-cylinder air-fuel ratio control amounts are set according to at least one of an rotational speed change amount of the engine and atmospheric pressure, and the cylinder-by-cylinder air-fuel ratio control amounts are limited so as to fall within an allowable range defined by the upper and lower limit values.

5 Claims, 15 Drawing Sheets

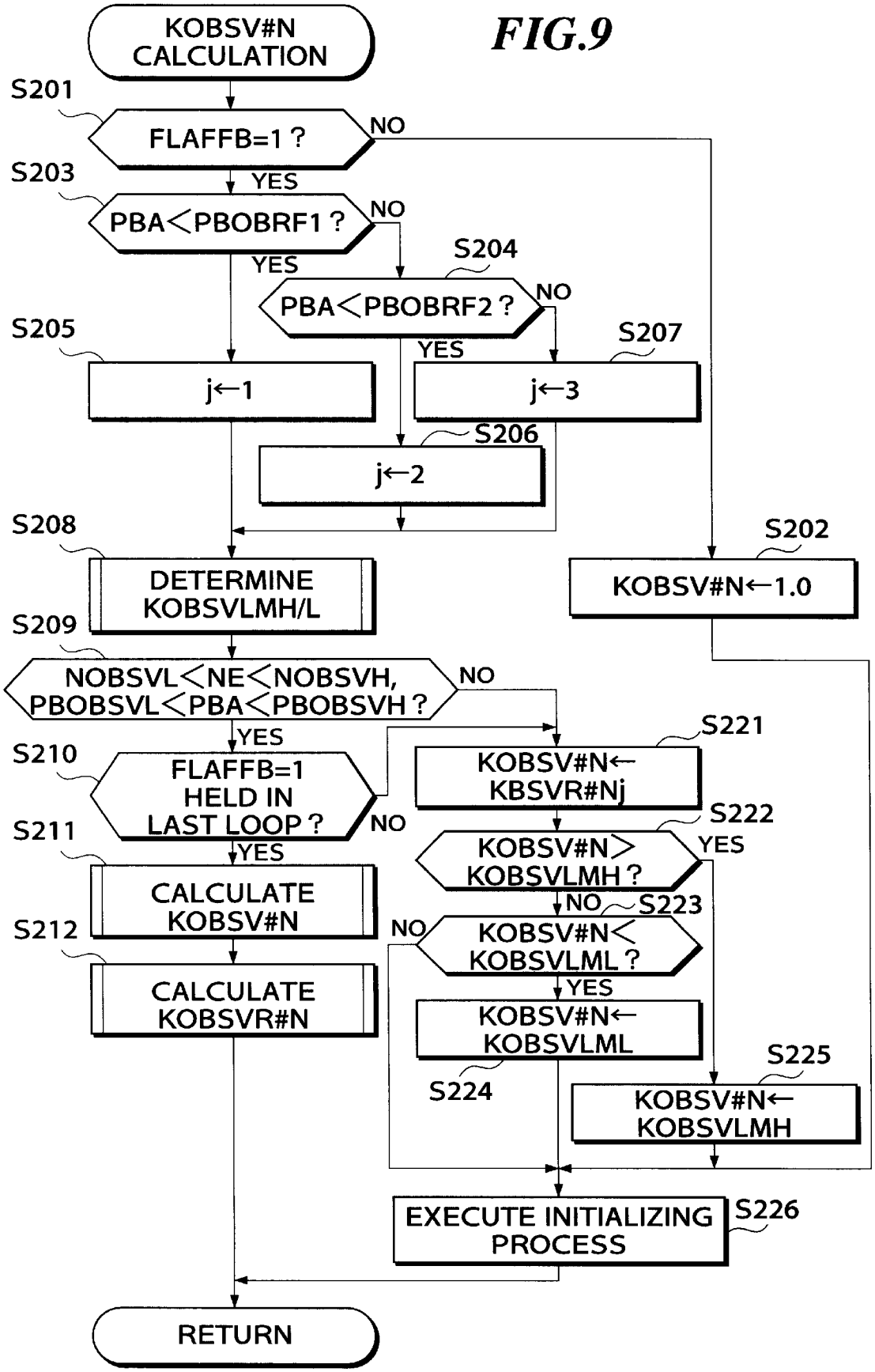
FIG.9
KOBSV#N CALCULATION
S201
FLAFFB=1 ?
NO
YES
S203
PBA<PBOBRF1 ?
NO
YES
S204
PBA<PBOBRF2 ?
NO
YES
S205
j←1
S207
j←3
S206
j←2
S208
DETERMINE KOBSVLMH/L
S202
KOBSV#N←1.0
S209
NOBSVL<NE<NOBSVH, PBOBSVL<PBA<PBOBSVH ?
NO
YES
S210
FLAFFB=1 HELD IN LAST LOOP ?
NO
YES
S221
KOBSV#N← KBSVR#Nj
S222
KOBSV#N> KOBSVLMH ?
YES
NO
S223
KOBSV#N< KOBSVLML ?
NO
YES
S211
CALCULATE KOBSV#N
S212
CALCULATE KOBSVR#N
KOBSV#N← KOBSVLML
S224
S225
KOBSV#N← KOBSVLMH
EXECUTE INITIALIZING PROCESS
S226
RETURN

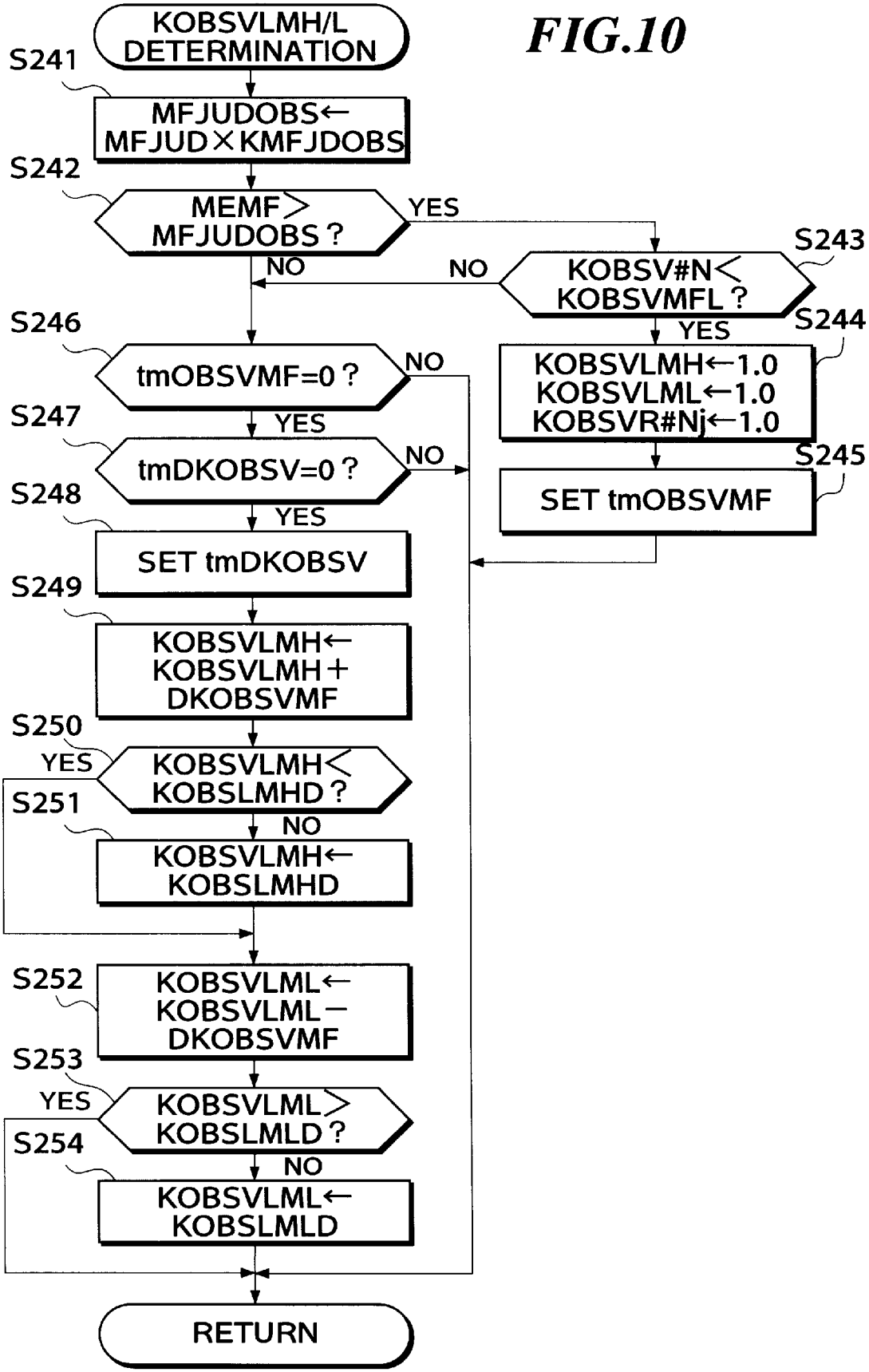
FIG.10
KOBSVLMH/L DETERMINATION
S241
MFJUDOBS← MFJUD×KMFJDOBS
S242
MEMF> MFJUDOBS ?
YES
NO
S243
KOBSV#N< KOBSVMFL ?
NO
YES
S244
KOBSVLMH←1.0
KOBSVLML←1.0
KOBSVR#Nj←1.0
S245
SET tmOBSVMF
S246
tmOBSVMF=0 ?
NO
YES
S247
tmDKOBSV=0 ?
NO
YES
S248
SET tmDKOBSV
S249
KOBSVLMH← KOBSVLMH+ DKOBSVMF
S250
KOBSVLMH< KOBSLMHD ?
YES
NO
S251
KOBSVLMH← KOBSLMHD
S252
KOBSVLML← KOBSVLML− DKOBSVMF
S253
KOBSVLML> KOBSLMLD ?
YES
NO
S254
KOBSVLML← KOBSLMLD
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which feedback-controls the air-fuel ratio of a mixture supplied to the engine cylinder by cylinder, by means of feedback control to which an observer based on a modern control theory is applied.

2. Prior Art

Conventionally, there has been proposed an air-fuel ratio-estimating system for internal combustion engines, for example, by Japanese Laid-Open Patent Publication (Kokai) No. 6-173755, which uses an observer to estimate the air-fuel ratio of a mixture supplied to each cylinder, based on an output from an air-fuel ratio sensor arranged in a confluent portion of the exhaust system of the engine, for generating an output proportional to the air-fuel ratio of exhaust gases. According to the system, when the estimated air-fuel ratio falls out of a range defined by predetermined upper and lower limit values, the estimated air-fuel ratio is reset to an initial value (value corresponding to A/F=14.7), to thereby prevent the estimated air-fuel ratio from diverging.

The proposed air-fuel ratio-estimating system can thus prevent the estimated air-fuel ratio from diverging by resetting the same to its initial value when the estimate air-fuel ratio falls out of the range defined by the predetermined upper and lower limit values. The system, however, has the disadvantage that it takes a considerable time period for the estimated air-fuel ratio to converge again to a desired air-fuel ratio. Further, although the flow rate of exhaust gases influences estimation of the air-fuel ratio for each cylinder (hereinafter referred to as "the cylinder-by-cylinder air-fuel ratio"), a change in the rotational speed of the engine and the density of air (atmospheric pressure) which influence the exhaust gas flow rate are not taken into consideration.

Further, when an air-fuel ratio control amount is calculated based on the detected air-fuel ratio of exhaust gases, and the air-fuel ratio of a mixture supplied to the engine is feedback-controlled based on the thus calculated air-fuel ratio control amount, the air-fuel ratio control amount is normally set to a predetermined upper or lower limit value when the former falls outside a range defined by the upper and lower limit values. In such a case, however, the predetermined upper and lower limit values are fixed values, and therefore, if the above-mentioned method of setting the air-fuel ratio control amount is applied as it is to cylinder-by-cylinder air-fuel ratio feedback control based on the estimated cylinder-by-cylinder air-fuel ratio, it can result in degraded controllability of the air-fuel ratio, since the predetermined upper and lower limit values can assume unsuitable values depending on the change in engine rotational speed and air density (atmospheric pressure).

SUMMARY OF THE INVENTION

It is the object of the invention to provide an air-fuel ratio control system for internal combustion engines, which is capable of suitably setting upper and lower limit values of an air-fuel ratio control amount for each cylinder of the engine by taking into consideration factors which influence the accuracy of the cylinder-by-cylinder air-fuel ratio estimated by the observer, to thereby maintain excellent controllability of the air-fuel ratio.

To attain the object, the present invention provides an air-fuel ratio control system for an internal combustion engine having a plurality of cylinders, and an exhaust system, including air-fuel ratio-detecting means arranged in the exhaust system, cylinder-by-cylinder air-fuel ratio-estimating means for estimating an air-fuel ratio of a mixture supplied to each of the cylinders cylinder by cylinder in response to an output from the air-fuel ratio-detecting means, by using an observer for observing an internal operative state of the exhaust system, based on a model representative of a behavior of the exhaust system, and cylinder-by-cylinder air-fuel ratio control means for calculating cylinder-by-cylinder air-fuel ratio control amounts corresponding respectively to the cylinders for carrying out feedback control of the air-fuel ratio of the mixture supplied to the each of the cylinders such that the estimated air-fuel ratio of the mixture supplied to the each of the cylinders is converged to a desired value, the air-fuel ratio control system being characterized by an improvement comprising:

limit-checking means for setting upper and lower limit values of the cylinder-by-cylinder air-fuel ratio control amounts according to at least one of an rotational speed change amount of the engine and atmospheric pressure, and for limiting the cylinder-by-cylinder air-fuel ratio control amounts so as to fall within an allowable range defined by the upper and lower limit values.

Preferably, the limit-checking means sets the upper and lower limit values of the cylinder-by-cylinder air-fuel ratio control amounts such that the allowable range defined by the upper and lower limit values is progressively expanded, when the rotational speed change amount is equal to or smaller than a predetermined threshold value.

More preferably, the limit-checking means sets the predetermined threshold value to a smaller value as at least one of rotational speed of the engine or load on the engine increases.

Preferably, the limit-checking means sets the upper and lower limit values of the cylinder-by-cylinder air-fuel ratio control amounts to values such that the cylinder-by-cylinder air-fuel ratio control amounts all assume a non-corrective value, when the rotational speed change amount exceeds the predetermined threshold value and at the same time a present value of the cylinder-by-cylinder air-fuel ratio control amounts is smaller than a predetermined value leaner than a value corresponding to a stoichiometric air-fuel ratio.

Advantageously, the limit-checking means sets the allowable range defined by the upper and lower limit values to a narrower range as atmospheric pressure lowers.

The above and other objects, features, and advantages of the invention will become more apparent from the following detailed description taken in conjunction with the accompanying drawings.

BRIEF DESCRIPTION OF THE DRAWINGS

FIG. 9 is a flowchart showing a subroutine (main routine) for calculating the cylinder-by-cylinder correction coefficient KOBSV#N, which is executed at a step S7 in FIG. 3;

FIG. 10 is a flowchart showing a subroutine for determining upper and lower limit values of the cylinder-by-cylinder correction coefficient KOBSV#N, which is executed at a step S208 in FIG. 9;

DETAILED DESCRIPTION

The invention will now be described in detail with reference to the drawings showing an embodiment thereof.

Figure 1:
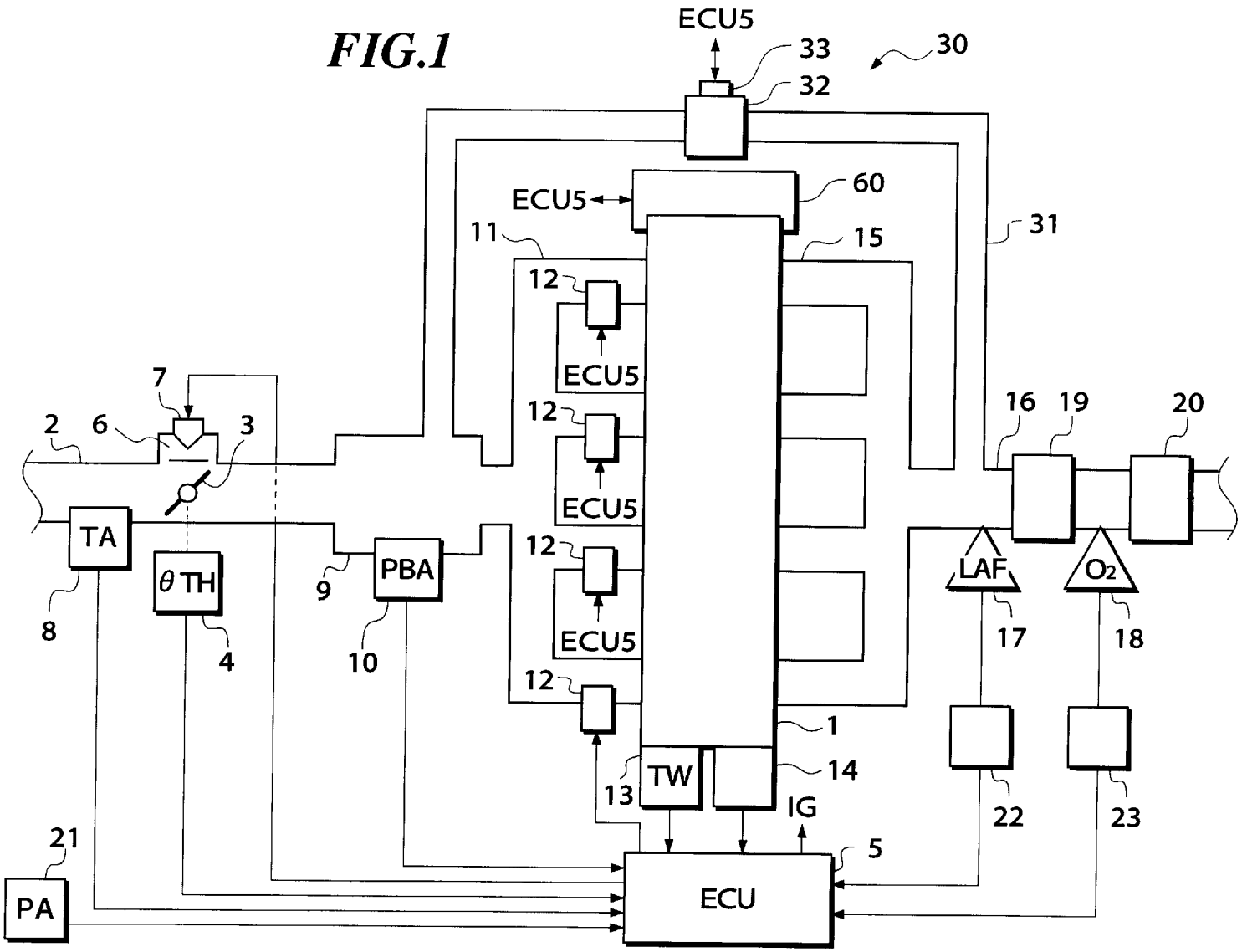
FIG. 1 is a block diagram showing the arrangement of an internal combustion engine incorporating an air-fuel ratio control system therefor, according to a first embodiment of the invention.

Referring first to FIG. 1, there is schematically shown the whole arrangement of an internal combustion engine and an air-fuel ratio control system therefor, according to an embodiment of the invention. In the figure, reference numeral 1 designates a four-cylinder type internal combustion engine (hereinafter simply referred to as "the engine").

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 in the form of a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5, for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as fuel injection timing and ignition timing, as well as for detecting the engine rotational speed NE.

Fuel injection valves 12 are inserted into the intake manifold 11 for respective cylinders at locations slightly upstream of intake valves, not shown. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to generate a high level signal when the mixture is richer than the stoichiometric air-fuel ratio, and a low level signal when the mixture is leaner than the same. The O2 sensor 18 is electrically connected via a low-pass filter 23 to the ECU 5, for supplying the ECU 5 with the high or low level signal.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 32 and supplying a signal indicative of the detected valve lift to the ECU 5. The EGR valve 32 is an electromagnetic valve having a solenoid which is electrically connected to the ECU 5, the valve lift of which is linearly changed by a control signal from the ECU 5.

The engine 1 includes a valve timing changeover mechanism 60 which changes valve timing of at least the intake valves out of the the intake valves and exhaust valves, not shown, between a high speed valve timing suitable for operation of the engine in a high speed operating region thereof and a low speed valve timing suitable for operation of the engine in a low speed operating region thereof. The changeover of the valve timing includes changeover of the valve lift amount as well, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21 for supplying an electric signal indicative of the sensed atmospheric pressure PA to the ECU 5.

The ECU 5 is comprised of an input circuit having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps and tables, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT (N) over which the fuel injection valves 12 are to be opened, by the use of the following equation (1), to output signals for driving the fuel injection valves 12, based on the results of the calculation:

$$TOUT(N)=TIMF\times KTOTAL\times KCMDM\times KLAF\times KOBSV\#N \quad (1)$$

where TIMF represents a basic value of the fuel injection amount TOUT(N), KTOTAL a correction coefficient, KCMDM a final desired air-fuel ratio coefficient, KLAF an air-fuel ratio correction coefficient, and KOBSV#N a cylinder-by-cylinder correction coefficient, respectively.

Figure 2:
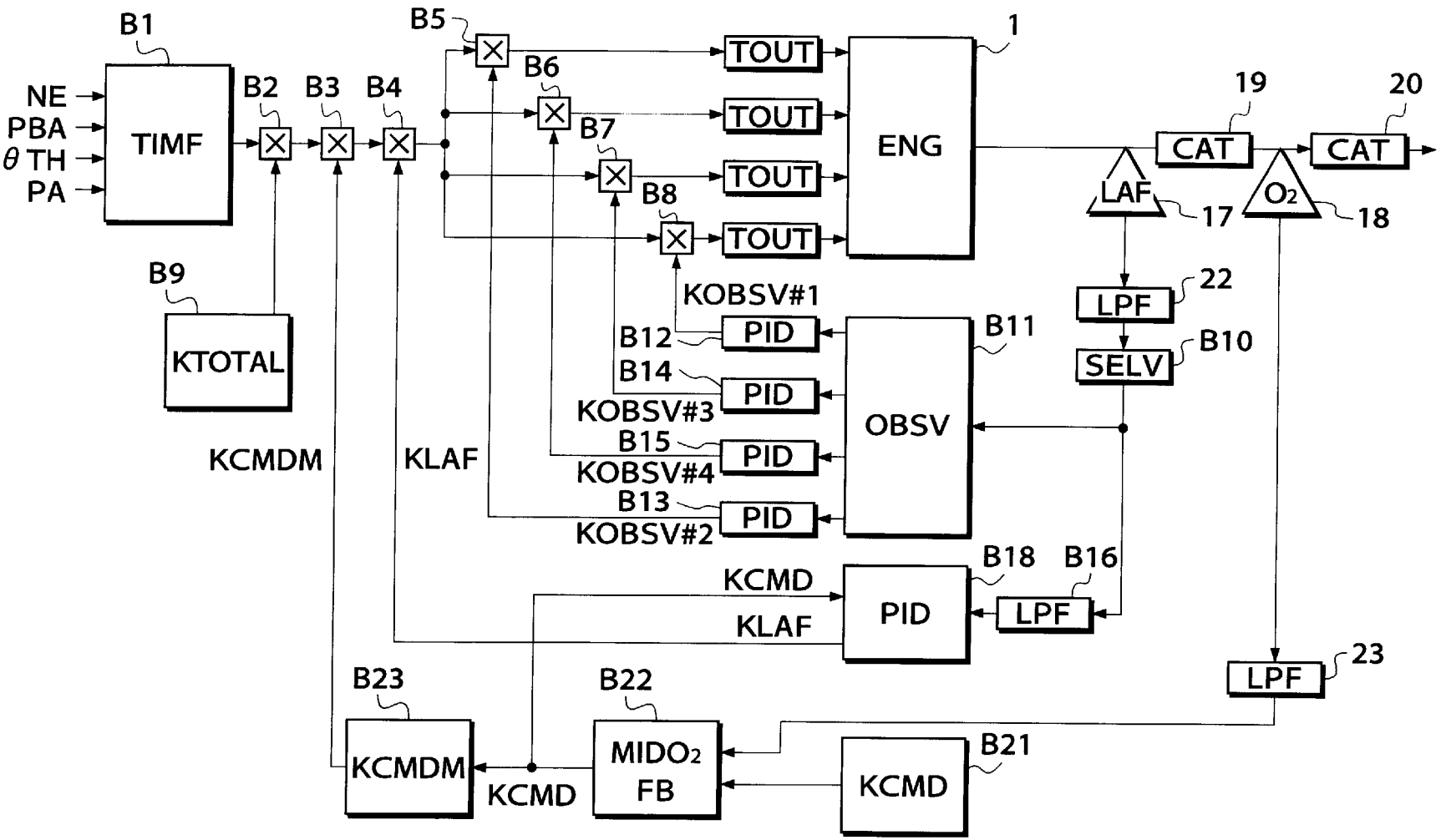
FIG. 2 is a block diagram useful in explaining a manner of controlling the air-fuel ratio of a mixture supplied to the engine.

FIG. 2 is a block diagram useful in explaining the manner of calculating the fuel injection period TOUT(N) by the use of the equation (1). With reference to the figure, an outline of the manner of calculating the fuel injection period TOUT (N) according to the present embodiment will be described. It should be noted that in the present embodiment, the amount of fuel to be supplied to the engine is calculated, actually, in terms of a time period over which the fuel injection valve 6 is opened (fuel injection period), but in the present specification, the fuel injection period TOUT(N) is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B4 designate multiplying blocks, which multiply the basic fuel amount TIMF by respective parameter values input thereto, and deliver the product values. These blocks carry out the arithmetic operation of the equation (1), and generate fuel injection amounts TOUT(N).

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purging-dependent correction coefficient KPUG set according to an amount of purged evaporative fuel during execution of purging by an evaporative fuel-processing system of the engine, not shown, to obtain the correction coefficient KTOTAL, which is supplied to the block B2.

A block B21 determines a desired air-fuel ratio coefficient KCMD, based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to blocks B18 and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to a block B11 and the block B18 via a low-pass filter block B16. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time or response speed of the LAF sensor per se changes depending on operating conditions of the engine.

The block B11 has the function of a so-called observer, i.e. a function of estimating a value of the air-fuel ratio separately for each cylinder from the air-fuel ratio (of a mixture of exhaust gases emitted from the cylinders) detected at the confluent portion of the exhaust system by the LAF sensor 17, and supplying the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N (N=1 to 4) as a cylinder-by-cylinder air-fuel ratio control amount by PID control such that the air-fuel ratio of each cylinder (the value of the air-fuel ratio estimated by the observer B11 for each cylinder) becomes equal to a value of the air-fuel ratio detected at the confluent portion, and supply KOBSV#N values to the blocks B5 to B8, respectively.

The block B18 calculates the PID correction coefficient KLAF through the PID control, based on the difference between the actual air-fuel ratio and the desired air-fuel ratio and supplies the KLAF value to the block B4.

As described above, in the present embodiment, the fuel injection amount TOUT(N) is calculated cylinder by cylinder by applying to the equation (1) the PID correction coefficient KLAF which is calculated by the ordinary PID control according to the output from the LAF sensor 17, as well as applying to the same equation the cylinder-by-cylinder correction coefficient KOBSV#N which is set according to the air-fuel ratio of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence obtain good exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings. It should be noted that in the following description, the suffix (k) represents sampling timing in the discrete system. (k) and (k−1), for example, indicate that values with these suffixes are the present value and the immediately preceding value, respectively. However, the suffix (k) indicating the present value is omitted unless required specifically.

Figure 3:
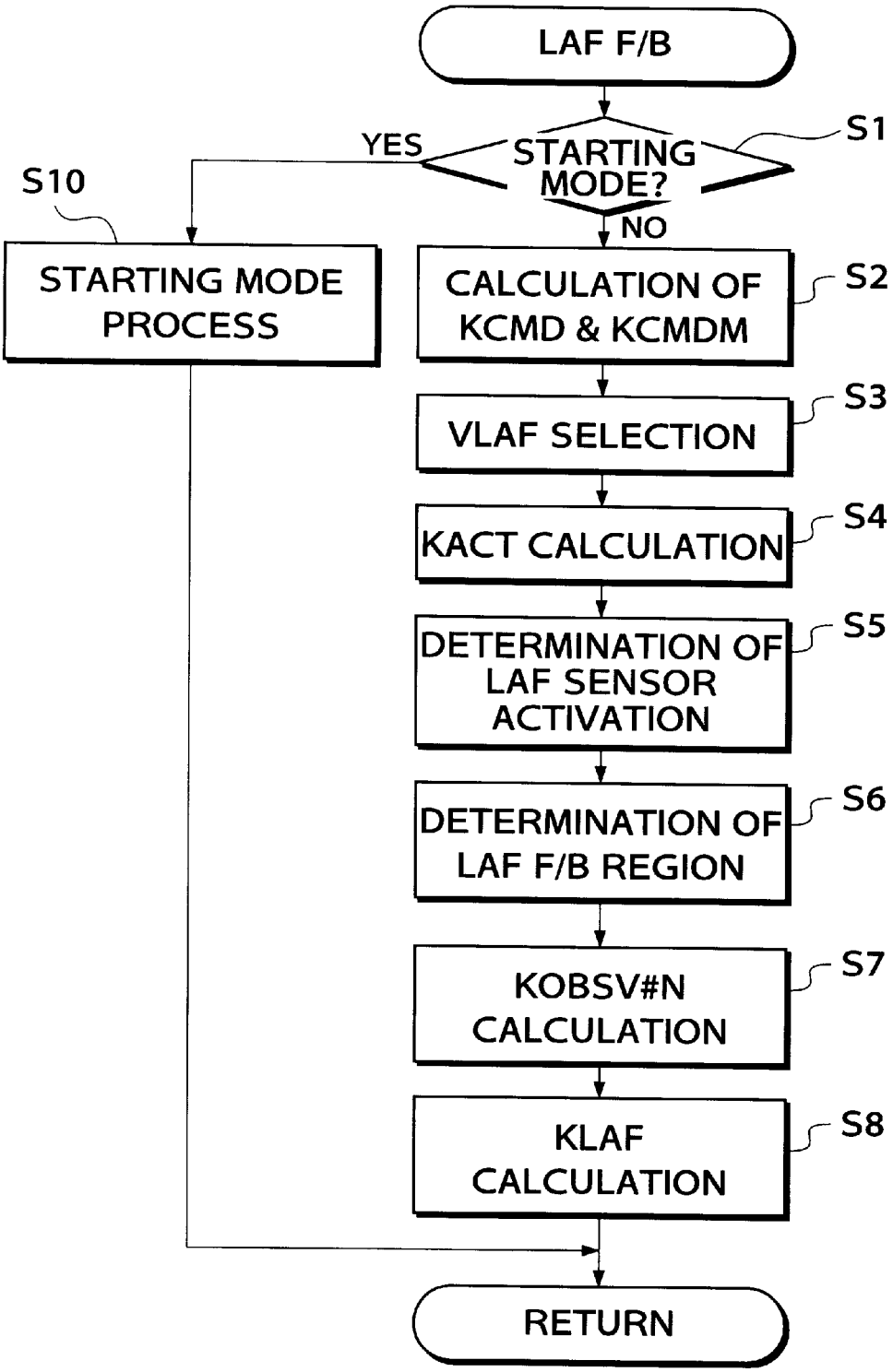
FIG. 3 is a flowchart showing a main routine for calculating a PID correction coefficient KLAF and a cylinder-by-cylinder correction coefficient KOBSV#N in response to an output from a LAF sensor appearing in FIG. 1.

FIG. 3 shows a main routine for calculating the PID correction coefficient KLAF and the cylinder-by-cylinder correction coefficient KOBSV#N in response to the output from the LAF sensor 17. This routine is executed in synchronism with generation of TDC signal pulses.

At a step S1, it is determined whether or not the engine is in a starting mode, i.e. whether or not the engine is cranking. If the engine is in the starting mode, the program proceeds to a step S10 to execute a process for the starting mode, not shown. If the engine is not in the starting mode, the desired air-fuel ratio coefficient (desired equivalent ratio) KCMD and the final desired air-fuel ratio coefficient KCMDM are calculated at a step S2, and the LAF sensor output-selecting process is executed at a step S3. Further, an actual equivalent ratio KACT depending on the output from the LAF sensor is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). If the engine 1 is in the LAF feedback control region, a feedback control flag FLAFFB is set to "1", whereas if the engine is in a region other than the above region, the flag FLAFFB is set to "0". Further, the cylinder-by-cylinder air-fuel ratio correction coefficient KOBSV#N and the PID correction coefficient KLAF are calculated at steps S7 and S8, respectively, followed by terminating the present routine.

More specifically, if the feedback control flag FLAFFB=1 holds at the step S6, the cylinder-by-cylinder correction coefficient KOBSV#N is calculated at the step S7 by executing a process of FIG. 9 (corresponding to a step S203 et seq.), hereinafter described, and then the PID correction coefficient KLAF is calculated through well-known PID control such that the actual equivalent ratio KACT becomes equal to the desired equivalent ratio KCMD at the step S8. On the other hand, if the feedback control flag FLAFFB=0 holds at the step S6, the cylinder-by-cylinder correction coefficient KOBSV#N is set to 1.0 at the step S7 and the KLAF value is set to a predetermined value determined according to operating conditions of the engine at the step S8.

Figure 4:
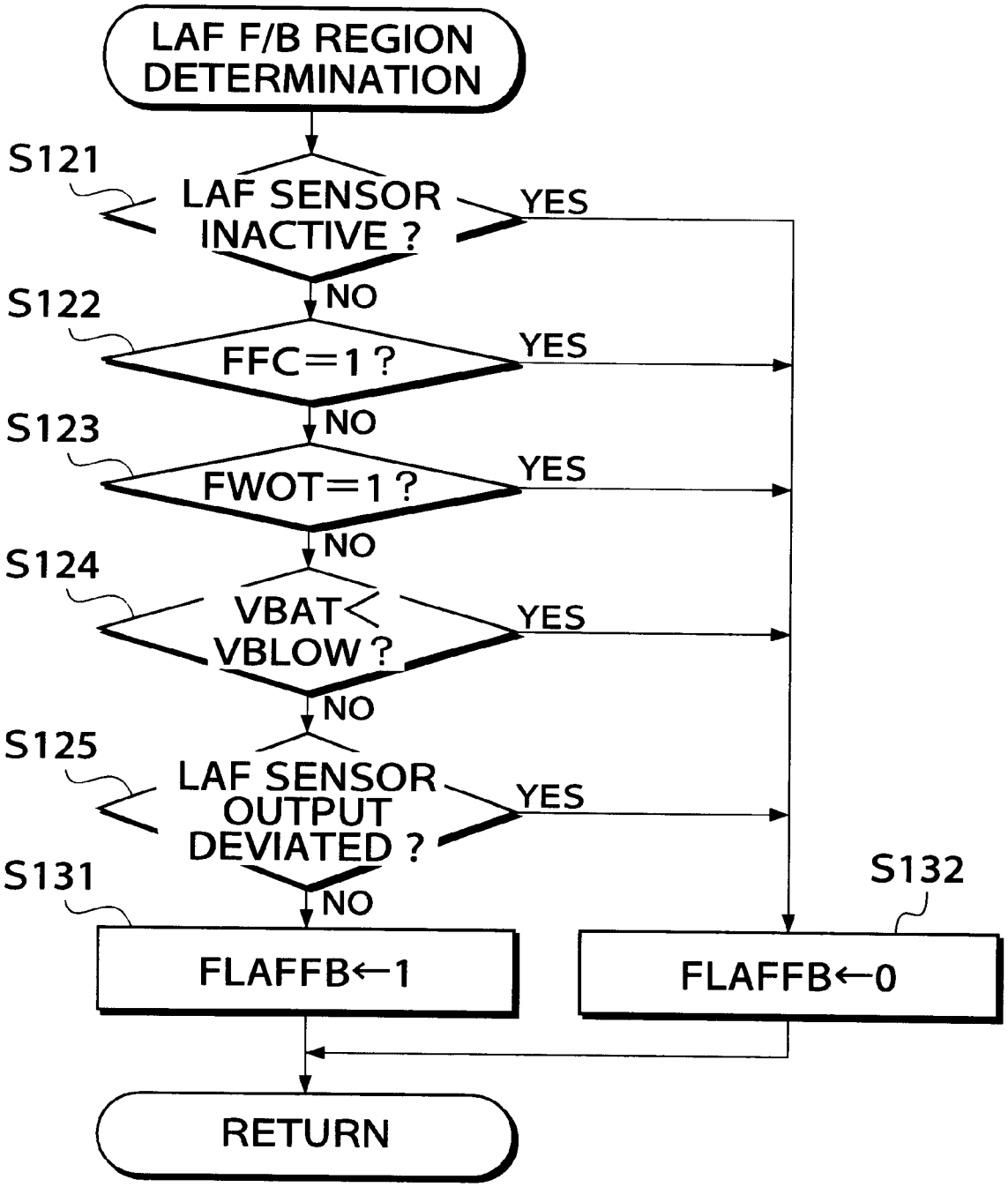
FIG. 4 is a flowchart showing a subroutine for carrying out a LAF feedback control region-determining process, which is executed at a step S6 in FIG. 3.

FIG. 4 shows a subroutine for carrying out a LAF feedback control region-determining process, which is executed at the step S6 in FIG. 3.

First, at a step S121, it is determined whether or not the LAF sensor 17 is in an inactive state. If the LAF sensor 17 is in an active state, it is determined at a step S122 whether or not a flag FFC which, when set to "1", indicates that fuel cut is being carried out, assumes "1". If FFC=0 holds, it is determined at a step S123 whether or not a WOT flag FWOT which, when set to "1", indicates that the engine is operating in a wide open throttle condition, assumes "1". If FWOT=1 does not hold, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from a proper value corresponding to the stoichiometric air-fuel ratio (LAF sensor output deviation). If any of the answers to the questions of the steps S121 to S125 is affirmative (YES), the feedback control flag FLAFFB which, when set to "1", indicates that the feedback control based on the LAF sensor output can be carried out, is set to "0" at a step S132.

On the other hand, if all the answers to the questions of the steps S121 to S125 are negative (NO), it is determined at a step S131 that the feedback control based on the LAF sensor output can be carried out, and therefore the feedback control flag FLAFFB is set to "1".

Next, description will be made of a calculation of the cylinder-by-cylinder correction coefficient KOBSV#N executed at the step S7 in FIG. 3.

In the following description, first, a manner of estimating the cylinder-by-cylinder air-fuel ratio by the observer will be described, and then a manner of calculating the cylinder-by-cylinder correction coefficient KOBSV#N according to the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of the air-fuel ratios of all the cylinders, whereby values of the air-fuel ratio detected at time points (k), (k+1), and (k+2) are expressed by equations (2A), (2B), and (2C), respectively. In preparing these equations, the fuel amount (F) was used as an operation amount or manipulated variable, and accordingly the fuel-air ratio F/A is used in these equations:

$$[F/A](k) = C_1[F/A\#1] + C_2[F/A\#3] + C_3[F/A\#4] + C_4[F/A\#2] \quad (2A)$$

$$[F/A](k+1) = C_1[F/A\#3] + C_2[F/A\#4] + C_3[F/A\#2] + C_4[F/A\#1] \quad (2B)$$

$$[F/A](k+2) = C_1[F/A\#4] + C_2[F/A\#2] + C_3[F/A\#1] + C_4[F/A\#3] \quad (2C)$$

Figure 5:
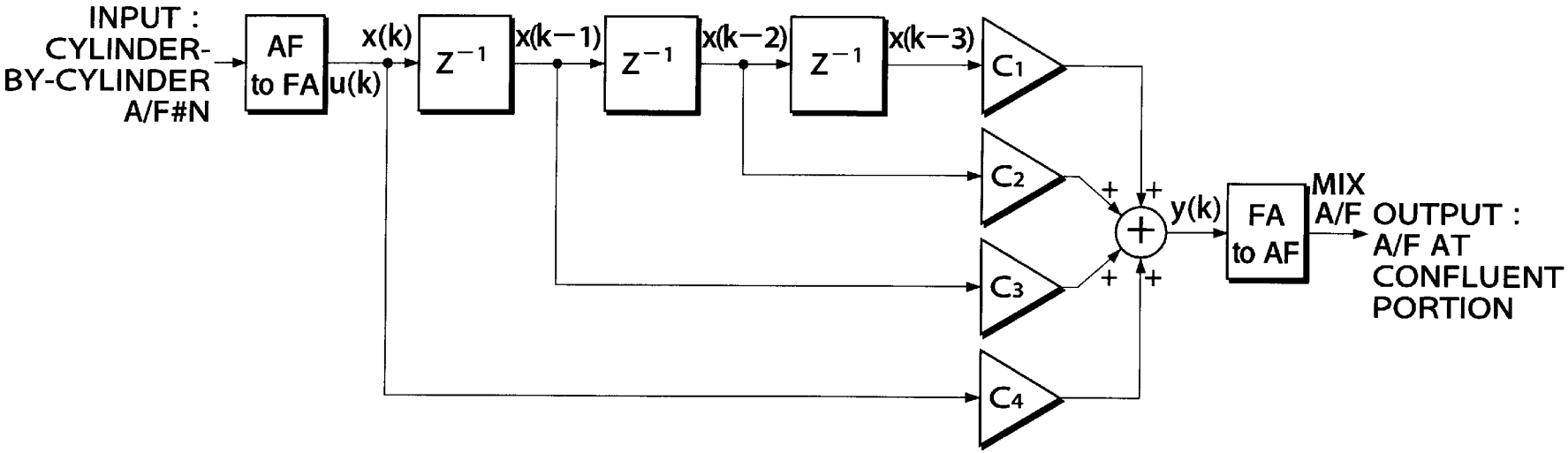
FIG. 5 is a block diagram showing a model representative of the behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in a block diagram as shown in FIG. 5, and the state equation therefor is expressed by the following equation (3) :

$$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \quad (3)$$

Further, if the fuel-air ratio detected at the confluent portion is designated by y(k), the output equation can be expressed by the following equation (4):

$$y(k) = [c_1 c_2 c_3] \begin{bmatrix} x(k-3) \\ x(k-2) \\ x(k-1) \end{bmatrix} + c_4 u(k) \quad (4)$$

where, $C_1$: 0.05, $C_2$: 0.15, $C_3$: 0.30, $C_4$: 0.50.

In the equation (4), u(k) cannot be observed, and hence an observer designed based on this state equation cannot perform observation of x(k). Therefore, on the assumption that a value of the air-fuel ratio detected four TDC signal pulses earlier (i.e. the immediately preceding value for the same cylinder) represents a value obtained under a steady operating condition of the engine in which any drastic change does not occur in the air-fuel ratio, it is regarded that x(k+1)=x(k−3), whereby the equation (4) can be transformed into the following equation (5):

$$\begin{bmatrix} x(k-2) \\ x(k-1) \\ x(k) \\ x(k+1) \end{bmatrix} = \begin{bmatrix} 0100 \\ 0010 \\ 0001 \\ 1000 \end{bmatrix} \begin{bmatrix} x(k-3) \\ x(k-2) \\ x(k-1) \\ x(k) \end{bmatrix} \quad (5)$$

$$y(k) = [c_1 c_2 c_3 c_4] \begin{bmatrix} x(k-3) \\ x(k-2) \\ x(k-1) \\ x(k) \end{bmatrix}$$

It has been empirically ascertained that the thus set model well represents the exhaust system of a four-cylinder type engine. Therefore, a problem arising from estimating the cylinder-by-cylinder air-fuel ratio from the air-fuel ratio A/F at the confluent portion of the exhaust system is the same as a problem with an ordinary Kalman filter used in observing x(k) by the following state equation and output equation (6). If weight matrices Q, R are expressed by the following equation (7), the Riccati's equation can be solved to obtain a gain matrix K represented by the following equation (8):

$$X(k+1)=AX(k)+Bu(k) \quad y(k)=CX(k)+Du(k) \quad (6)$$

where $$A = \begin{bmatrix} 0100 \\ 0010 \\ 0001 \\ 1000 \end{bmatrix} \quad C = [c_1 c_2 c_3 c_4] \quad B = D = [0] \quad (7)$$

$$X(k) = \begin{bmatrix} x(k-3) \\ x(k-2) \\ x(k-1) \\ x(k) \end{bmatrix}$$

$$Q = \begin{bmatrix} 1000 \\ 0100 \\ 0010 \\ 0001 \end{bmatrix} \quad R = [1]$$

$$K = \begin{bmatrix} -0.3093 \\ 1.1916 \\ 0.3093 \\ 0.0803 \end{bmatrix} \quad (8)$$

Figure 6:
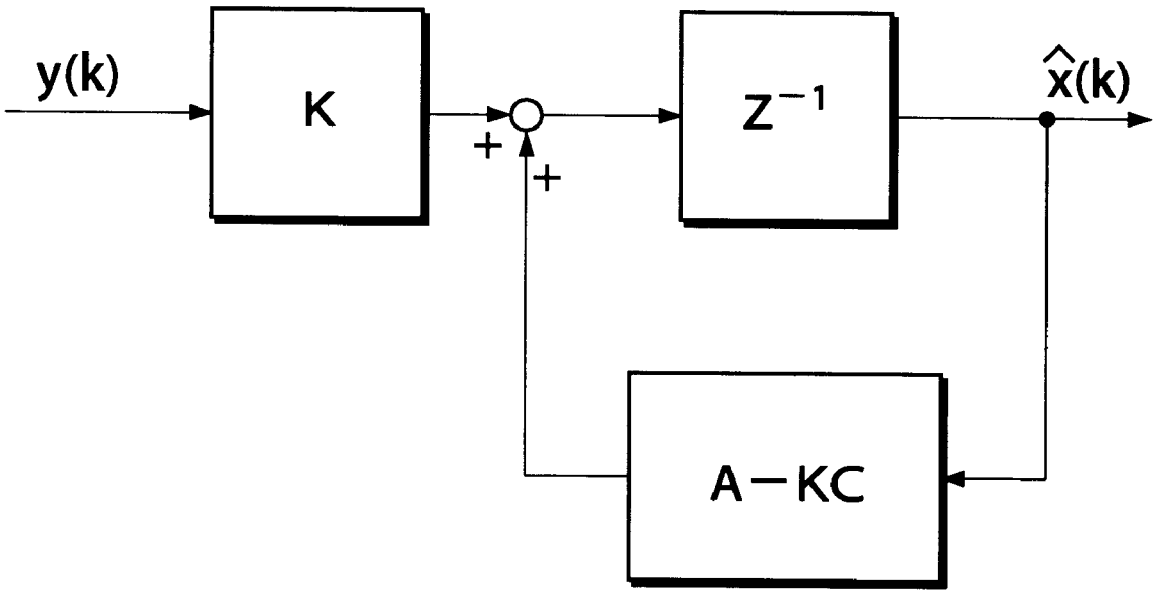
FIG. 6 is a block diagram showing the construction of an observer, which is applied to the model of the exhaust system.

In the model of the present embodiment, there is no inputting of u(k) which is input to an observer of a general type, so that the observer of the present embodiment is constructed such that y(k) alone is input thereto as shown in FIG. 6, which is expressed by the following equation (9):

$$\hat{X}(k+1) = [A - KC]\hat{X}(k) + Ky(k) = A\hat{X}(k) + K\left(y(k) - C\hat{X}(k)\right) \quad (9)$$

$$\hat{X}(k) = \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value $\hat{X}(k)$ of the cylinder-by-cylinder fuel-air ratio obtained in the past, the estimated value $\hat{X}(k+1)$ of the same in the present loop can be calculated.

When the above equation (9) is employed to calculate the cylinder-by-cylinder fuel-air ratio $\hat{X}(k+1)$, the actual equivalent ratio KACT(k) is substituted for the fuel-air ratio y(k) at the confluent portion. However, the actual equivalent ratio KACT(k) contains the response delay of the LAF sensor 17, whereas the $C\hat{X}(k)$ value (weighted sum of four cylinder-by-cylinder fuel-air ratio values) does not contain the response delay. Therefore, the cylinder-by-cylinder fuel-air ratio cannot be accurately estimated by the use of the equation (9), due to the influence of the response delay of the LAF sensor 17. Especially, at a high engine rotational speed NE when time intervals at which TDC signal pulses are generated are shorter, the influence of the response delay upon the accuracy of the estimation is large.

According to the present embodiment, therefore, an estimated value $\hat{y}(k)$ of the fuel-air ratio at the confluent portion is calculated by the use of the following equation (10), and the thus calculated value $\hat{y}(k)$ is applied to the following equation (11), to thereby calculate the estimated value $\hat{X}(k+1)$ of the cylinder-by-cylinder fuel-air ratio:

$$\hat{y}(k) = DL\hat{y}(k-1) + (1 - DL)C\hat{X}(k) \quad (10)$$

$$\hat{X}(k+1) = A\hat{X}(k) + K(y(k) - \hat{y}(k)) \quad (11)$$

Figure 7:
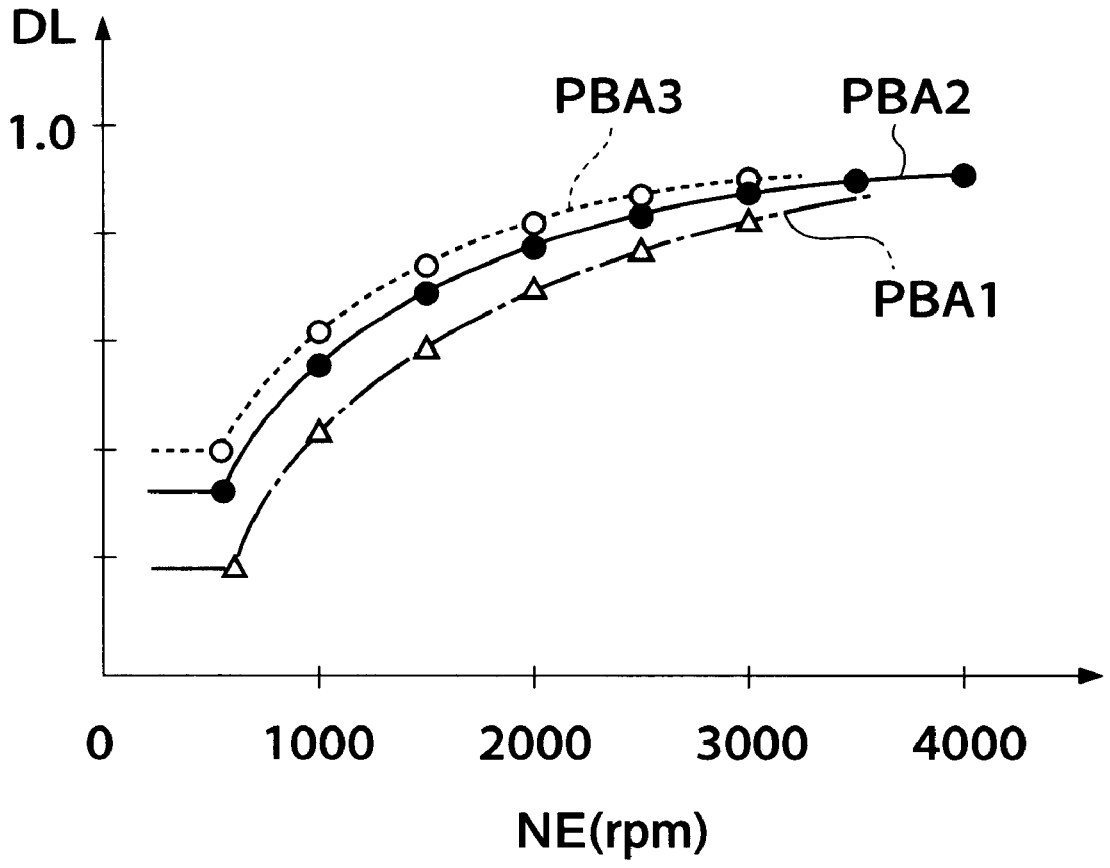
FIG. 7 shows a table for determining a response delay time constant DL for the LAF sensor.

In the above equation (10), DL represents a parameter corresponding to a time constant of the response delay of the LAF sensor 17, which is determined from a DL table shown in FIG. 7. The DL table is set such that the DL value is set to a value between 0 and 1.0 according to the engine rotational speed NE and the intake pipe absolute pressure PBA. In the figure, PBA1 to PBA3 represent 660 mmHg, 460 mmHg, and 260 mmHg, respectively, and an interpolation is carried out when the NE and/or PBA value falls between the predetermined values. It has been empirically ascertained that the best compensation for the response delay of the LAF sensor 17 can be obtained if the time constant DL is set to a value corresponding to a time period longer than the actual response delay by approximately 20%. Further, as is apparent from FIG. 7, the time constant DL changes only by a small amount with respect to the change in the intake pipe absolute pressure PBA. Therefore, the DL value may be determined such that an average value of the DL values corresponding to the PBA1, PBA2, and PBA3 is calculated, and a value of the thus calculated average value is selected according to the engine rotational speed NE.

In the above equations (10) and (11), an initial vector of the $\hat{X}(k)$ value is set such that component elements thereof $\hat{x}(k-3)$, $\hat{x}(k-2)$, $\hat{x}(k-1)$, $\hat{x}(k)$) are all equal to a vector of the actual equivalent ratio KACT, and in the equation (10), an initial value of the estimated value $\hat{y}(k-1)$ is set equal to the actual equivalent ratio KACT.

By thus using the equation (11) which is obtained by replacing the $C\hat{X}(k)$ in the equation (9) by the estimated value $\hat{y}(k)$ of the fuel-air ratio at the confluent portion containing the response delay, the response delay of the LAF sensor can be properly compensated for, to thereby carry out accurate estimation of the cylinder-by-cylinder air-fuel ratio. In the following description, estimated equivalent ratio values KACT#1(k) to KACT#4(k) for the respective cylinders correspond to the $\hat{x}(k)$ value.

Figure 8:
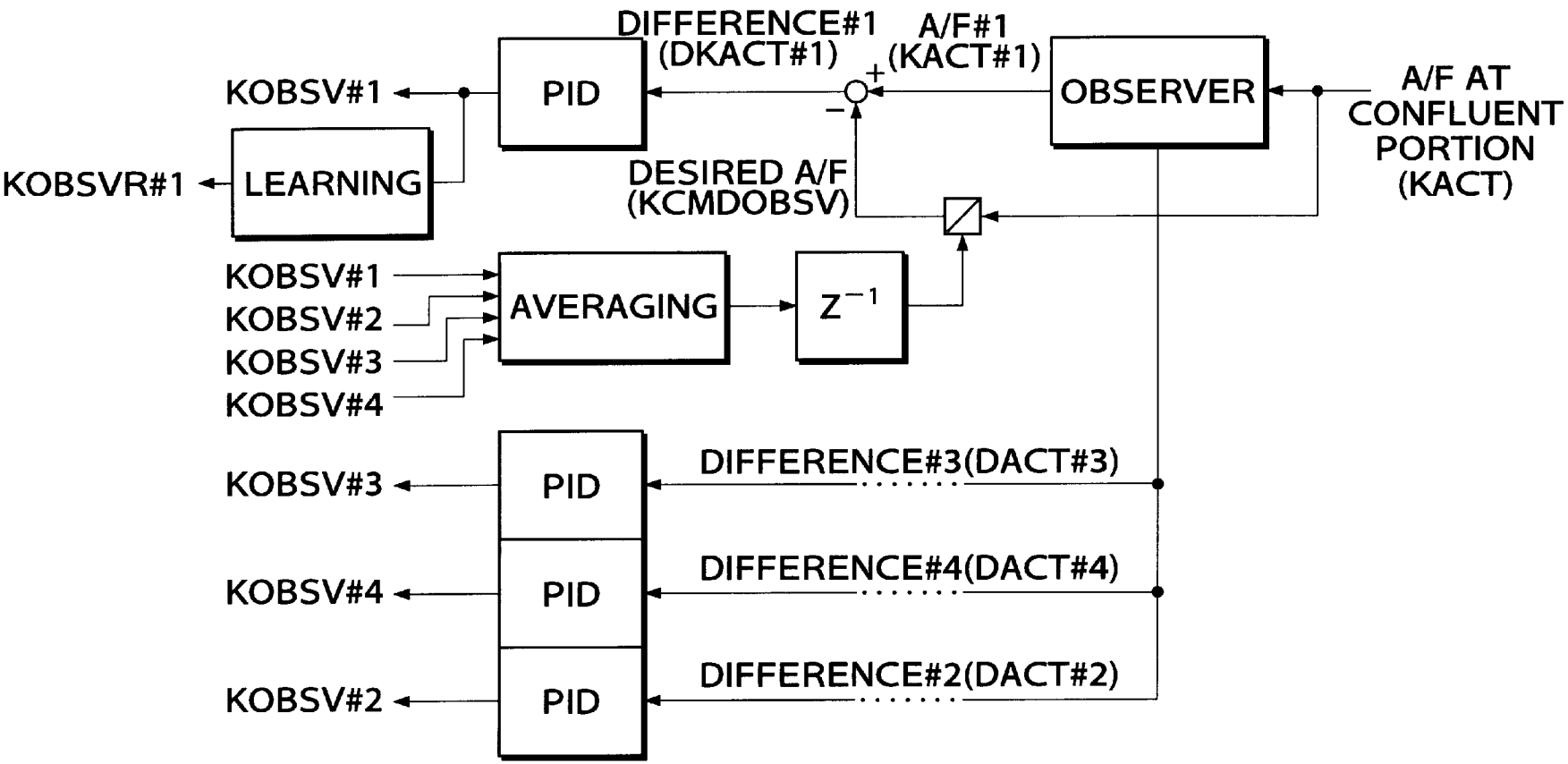
FIG. 8 is a diagram which is useful in explaining the manner of cylinder-by-cylinder air-fuel ratio feedback control.

Next, description will be made of the manner of calculating the cylinder-by-cylinder correction coefficient KOBSV#N according to the thus estimated cylinder-by-cylinder air-fuel ratio, with reference to FIG. 8.

As shown in the following equation (12), the actual equivalent ratio KACT corresponding to the air-fuel ratio A/F at the confluent portion is divided by the immediately preceding value of an average value of values of the cylinder-by-cylinder correction coefficient KOBSV#N for all the cylinders, to thereby calculate a desired value KCMDOBSV(k) as an equivalent ratio corresponding to the desired air-fuel ratio. The cylinder-by-cylinder correction coefficient KOBSV#1 of the #1 cylinder is calculated by the PID control such that the difference DKACT#1(k) (=KACT#1(k)−KCMDOBSV(k)) between the desired value KCMDOBSV(k) and the estimated equivalent ratio KACT#1(k) of the #1 cylinder becomes equal to zero:

$$KCMDOBSV(k) = \frac{KACT(k)}{\sum_{N=1}^{4} KOBSV\#N(k-1)/4} \quad (12)$$

More specifically, a proportional term KPOB#1, an integral term KIOB#1, and a differential term KDOB#1 for use in the PID control are calculated by the use of the respective following equations (13A), (13B), and (13C), to thereby calculate the cylinder-by-cylinder correction coefficient KOBSV#1 by the use of the following equation (14):

$$KPOB\#1(k) = KPOBSV \times DKACT\#1(k) \quad (13A)$$

$$KIOB\#1(k) = KIOBSV \times DKACT\#1(k) + KIOB\#1(k-1) \quad (13B)$$

$$KDOB\#1(k) = KDOBSV \times (DKACT\#1(k) - DKACT\#1(k-1)) \quad (13C)$$

$$KOBSV\#1(k) = KPOB\#1(k) + KIOB\#1(k) + KDOB\#1(k) \quad (14)$$

where KPOBSV, KIOBSV and KDOBSV represent a basic proportional term, a basic integral term, and a basic differential term, respectively.

The same calculations are carried out with respect to the cylinders #2 to #4, to obtain the cylinder-by-cylinder correction coefficients KOBSV#2 to KOBSV#4 therefor.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio.

Further, a learned value KOBSVR#N of the cylinder-by-cylinder correction coefficient KOBSV#N is calculated for each of the three engine operating regions by the use of the following equation (15) and stored in the back-up RAM backed up by the battery:

$$KOBSVR\#j=CR\times KOBSV\#N+(1-CR)\times KOBSVR\#Nj \quad (15)$$

where i (j=1 to 3) represents a parameter representative of the operating region which is determined according to the intake pipe absolute pressure PBA, as described hereinafter, CR a weighting coefficient set to a value between 0 to 1, and KOBSVR#Nj on the right side the immediately preceding learned value.

FIG. 9 shows a subroutine for calculating the cylinder-by-cylinder correction coefficient KOBSV#N, which corresponds to the step S7 in FIG. 3.

First, at a step S201, it is determined whether or not the feedback control flag FLAFFB assumes "1". If FLAFFB=0 holds, which means that the engine is not in the LAF feedback control region, the cylinder-by-cylinder correction coefficient KOBSV#N is set to "1.0" at a step S202, and an initializing process is executed at a step S226, followed by terminating the present routine. In the initializing process at the step S226, the values $\hat{x}(k-3)$, $\hat{x}(k-2)$, $\hat{x}(k-1)$, and $\hat{x}(k)$ in the above equations (10) and (11), and the value $\hat{y}(k-1)$ in the equation (10) are all set to the actual equivalent ratio KACT, the value DKACT#N in the equations (13A) to (13C) to 0, and the value KIOB#N in the equation (13A) to the cylinder-by-cylinder correction coefficient KOBSV#N, respectively.

Figure 14:
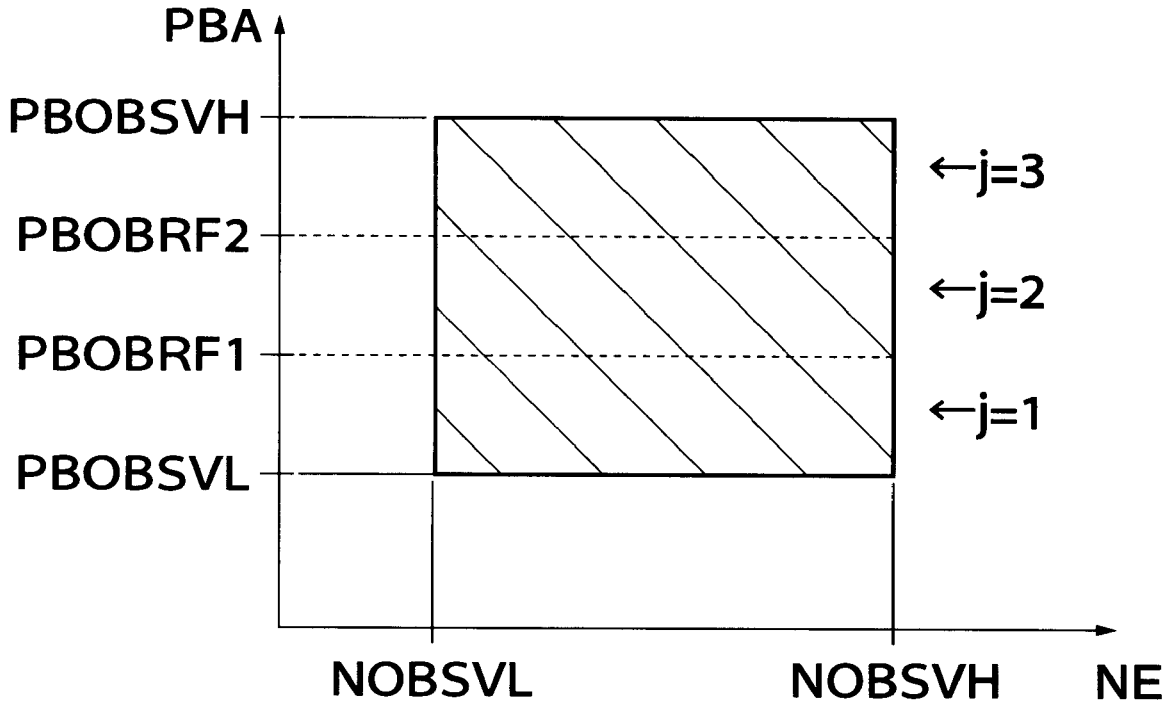
FIG. 14 is a graph showing the manner of determining cylinder-by-cylinder air-fuel ratio feedback control region.

If FLAFFB=1 holds at the step S201, the engine operating region is determined according to the intake pipe absolute pressure PBA at steps S203 to S207 (see FIG. 14). More specifically, when the engine is in a low load region where the intake pipe absolute pressure PBA is below a first predetermined value PBOBRF1, the operating region parameter i is set to "1" at the steps S203 and S205, when the engine is in an intermediate load region where the intake pipe absolute pressure PBA is equal to or above the first predetermined value PBOBRF1 and at the same time below a second predetermined value PBOBRF2 which is higher than the first predetermined value PBOBRF1, the operating region parameter j is set to "2" at the steps S203, S204 and S206, and when the engine is in a high load region where the intake pipe absolute pressure PBA is equal to or above the second predetermined value PBOBRF2, the operating region parameter j is set to "3" at the steps S203, S204 and S207.

At the following step S208, a KOBSVLMH/L-determinating process, described hereinafter with reference to FIG. 10, is executed to determine an upper limit value KOBSVLMH and a lower limit value KOBSVLML of the cylinder-by-cylinder correction coefficient KOBSV#N. Then, it is determined at a step S209 whether or not the engine rotational speed NE is in a range between predetermined upper and lower limit values NOBSVH and NOBSVL (e.g. 4000 rpm and 1000 rpm, respectively) and the intake pipe absolute pressure PBA is in a range between predetermined upper and lower limit values PBOBSVH and PBOBSVL (e.g. 760 mmHg and 200 mmHg, respectively) (see FIG. 14). If NE≦NOBSVL or NE≧NOBSVH holds, or PBA≦PBOBSVL or PBA≧PBOBSVH holds, the cylinder-by-cylinder correction coefficient KOBSV#N is set to the learned value KOBSVR#Nj corresponding to the determined engine operating region at a step S221, and then limit-checking of the cylinder-by-cylinder correction coefficient KOBSV#N is carried out at steps S222 to S225. More specifically, if the cylinder-by-cylinder correction coefficient KOBSV#N is larger than an upper limit value KOBSVLMH, the former is set to the latter at the steps S222 and S225, whereas if the value KOBSV#N is smaller than a lower limit value KOBSVLML, the former is set to the latter at the steps S223 and S224. If the value KOBSV#N is in a range between the upper and lower limit values KOBSVLMH and KOBSVLML, the program proceeds to a step S226 without executing the limit-checking.

If the answer to the question of the step S209 is affirmative (YES), it is determined at a step S210 whether or not the feedback control flag FLAFFB assumed "11" in the last loop of execution of this routine. If it is determined at the step S210 that FLAFFB=0 held in the last loop, a KOBSV#N-calculating process of FIG. 11 and a KOBSVR#N-calculating process of FIG. 12 are executed at steps S211 and S212, respectively, followed by terminating the present routine.

FIG. 10 shows a subroutine for carrying out the KOBSVLMH/L-determinating process, which is executed at the step S208 in FIG. 9.

Figure 15A:
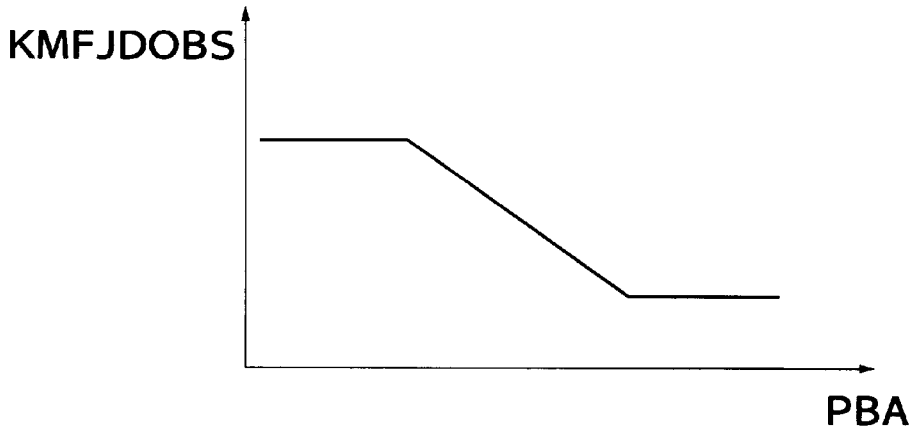
FIG. 15A shows a table for determining a correction coefficient of an engine rotational speed change threshold value according to intake pipe absolute pressure PBA.

First, at a step S241, a rotational speed change threshold value MFJUDOBS is calculated by the use of the following equation (16):

$$MFJUDOBS=MFJUD\times KMFJDOBS \quad (16)$$

where MFJUD represents a basic value of the rotational speed change threshold value determined by retrieving an MFJUD map which is set according to the engine rotational speed NE and the intake pipe absolute pressure PBA. More specifically, the MFJUD map is set such that map values of the basic value MFJUD are smaller as the engine rotational speed NE increases and/or the intake pipe absolute pressure PBA increases. Further, KMFJDOBS represents a correction coefficient of the rotational speed change threshold value determined by retrieving a KMFJDOBS table which is set according to the intake pipe absolute pressure PBA. More specifically, the KMFJDOBS table, shown in FIG. 15A, is set such that table values of the correction coefficient KMFJDOBS are smaller as the intake pipe absolute pressure PBA increases.

At the following step S242, it is determined whether or not a detected value of an engine rotational speed change amount MEMF is larger than the threshold value MFJUDOBS calculated at the step S241. The rotational speed change amount MEMF is a parameter defined by the following equation (17) provided that a present value of a time period required for the crankshaft to rotate through a predetermined angle (e.g. 30 degrees), i.e. an amount proportional to 1/NE, is designated by ME(k):

$$MEMF=ME(k)-ME(k-1) \quad (17)$$

If the rotational speed change amount MEMF is larger than the threshold value MFJUDOBS, it is determined at a step S243 whether or not the cylinder-by-cylinder correction coefficient KOBSV#N for a cylinder for which the present calculation is carried out (hereinafter referred to as "the present cylinder") is smaller than a lean-side predetermined value KOBSVMFL (e.g. 0.96). If KOBSV#N<KOBSVMFL holds, which means that the cylinder-by-cylinder correction coefficient KOBSV#N is leaner than 1.0, the upper limit value KOBSVLMH, the lower limit value KOBSVLML, and the learned value KOBSVR#Nj (j=1 to 3) are all set to 1.0 at a step S244, and a down-counting timer tmOBSVMF is set to a predetermined time period TOBSVMF (e.g. 3 min) and started at a step S245, followed by terminating the present routine.

Figure 11:
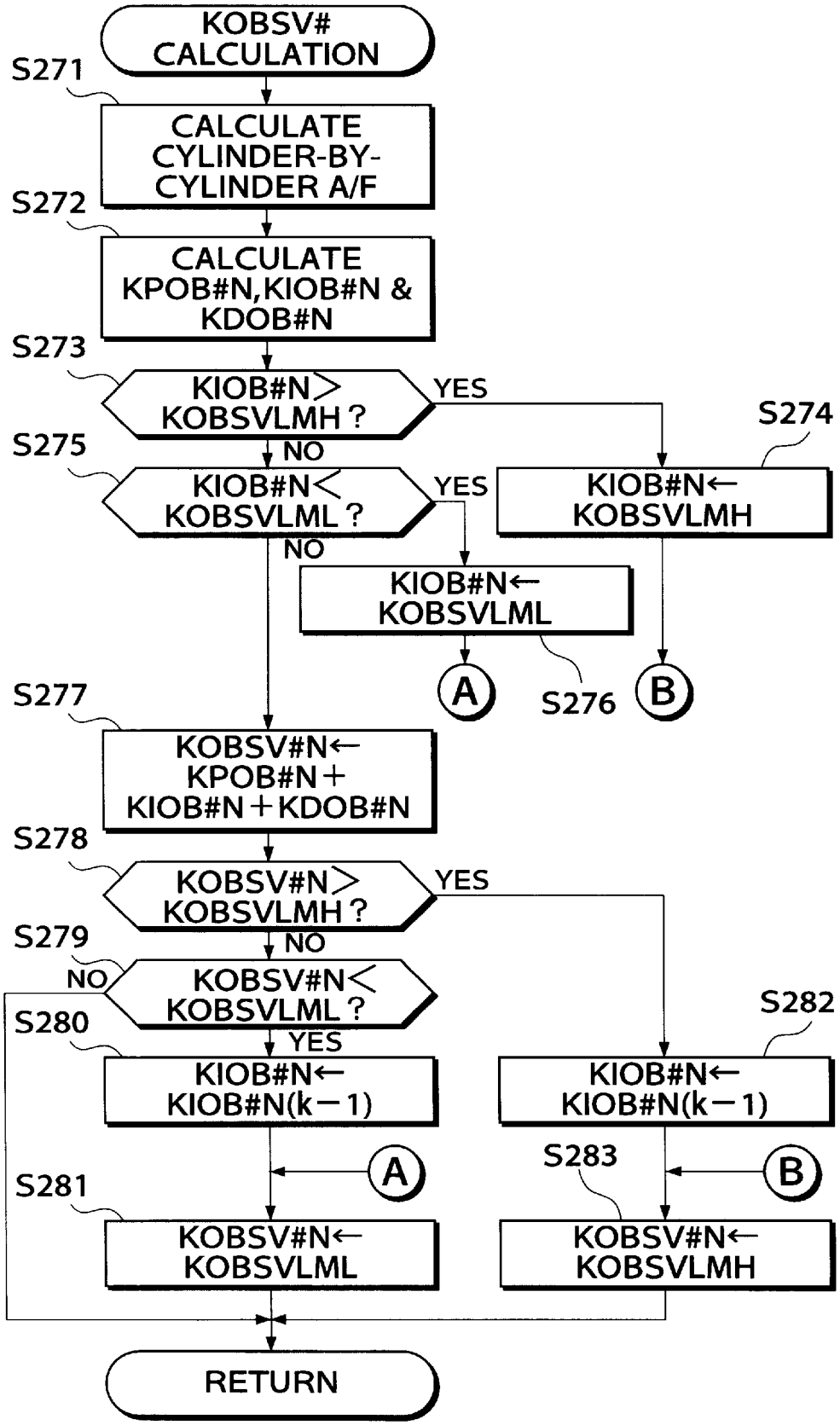
FIG. 11 is a flowchart showing a subroutine for calculating the cylinder-by-cylinder correction coefficient KOBSV#N, which is executed at a step 211 in FIG. 9.
Figure 12:
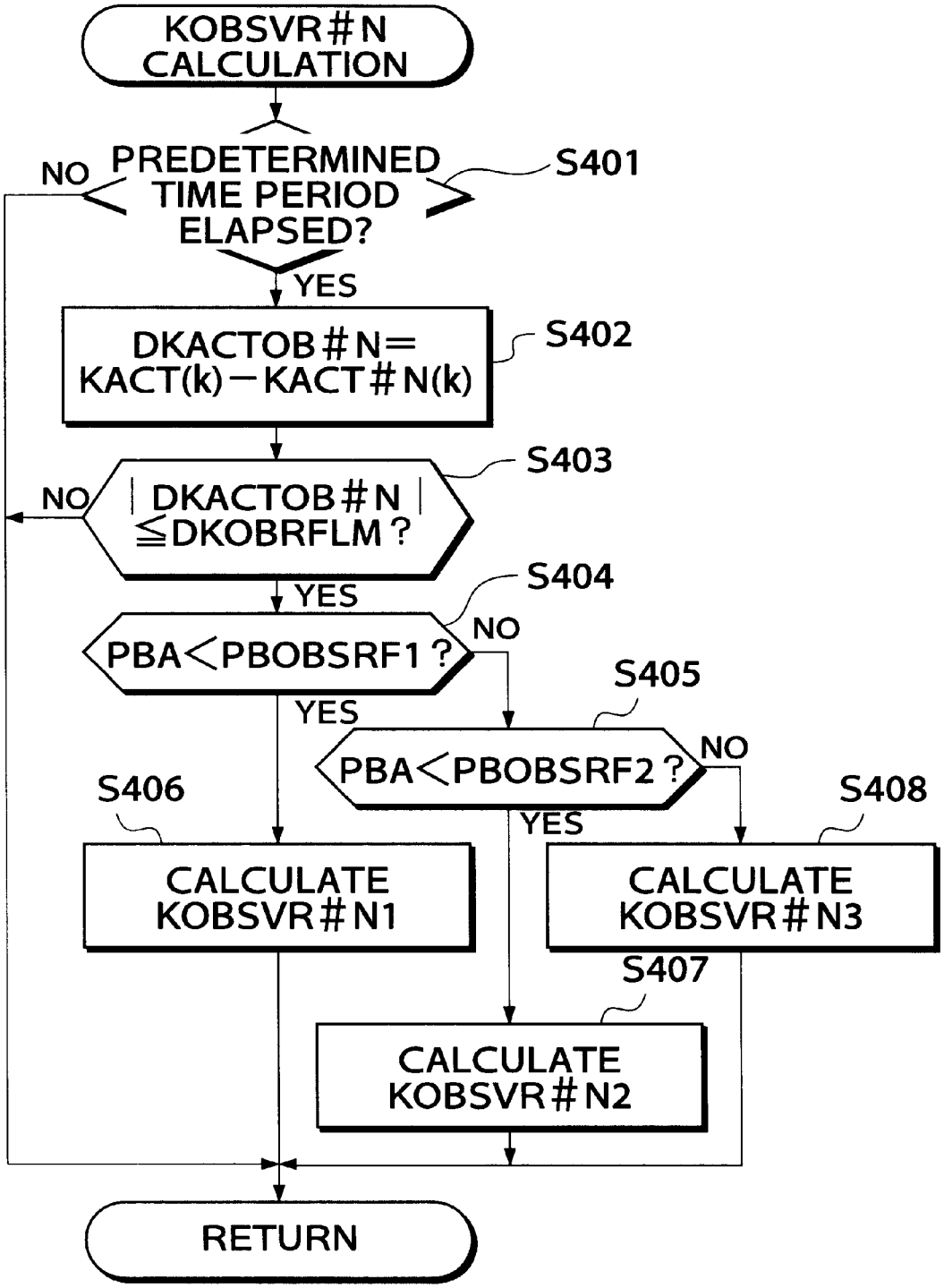
FIG. 12 is a flowchart showing a subroutine for calculating a learned value KOBSVR#Nj of the cylinder-by-cylinder correction coefficient KOBSV#N, which is executed at a step S212 in FIG. 9.

If it is determined that the rotational speed change amount is large and at the same time the cylinder-by-cylinder correction coefficient KOBSV#N of the present cylinder assumes a leaner value, the upper and lower limit values KOBSVLMH, KOBSVLML are set to 1.0 (steps S242 to S244) as described above, and hence the cylinder-by-cylinder correction coefficient KOBSV#N is also set to 1.0 (non-corrective value) due to execution of steps S278 to S283 in FIG. 11, referred to hereinafter. As a result, an increase in the rotational speed change amount caused by extreme leaning of the air-fuel ratio of a particular cylinder can be prevented.

If the answer to the question of the step S242 or S243 is negative (NO), i.e. if MEMF≦MFJUDOBS holds, which means that the rotational speed change amount is small, or MEMF>MFJUDOBS holds and at the same time the cylinder-by-cylinder correction coefficient KOBSV#N is larger than the lean-side predetermined value KOBSVMFL, it is determined at a step S246 whether or not the count value of the timer tmOBSMF which has been started at the step S245 is equal to 0. So long as tmOBSVMF>0 holds, the present routine is immediately terminated. On the other hand, if tmOBSVMF=0 holds, which means that a state where the answer to the question of the step S242 or S243 is negative (NO) has continued over the predetermined time period TOBSVMF or more, it is determined at a step S247 whether or not the count value of a down-counting timer tmDKOBSV which is started at the following step S248 is equal to 0. So long as tmDKOBSV>0 holds, the present routine is immediately terminated. On the other hand, if tmDKOBSV=0 holds, the timer tmDKOBSV is set to a predetermined time period TDKOBSV (e.g. 10 sec) and started at the step S248.

Then, the upper limit value KOBSVLMH is updated by adding thereto a predetermined value DKOBSVMF (e.g. 0.001) at a step S249, and it is determined at a step S250 whether or not the thus updated upper limit value is smaller than an upper guard value KOBSLMHD which is set according to the atmospheric pressure PA. If KOBSVLMH<KOBSLMHD holds, the program skips to a step S252. On the other hand, if KOBSVLMH≧KOBSLMHD holds, the upper limit value KOBSVLMH is set to the upper guard value KOBSLMHD at a step S251, followed by the program proceeding to the step S252.

At the step S252, the lower limit value KOBSVLML is updated by subtracting therefrom the predetermined value DKOBSVMF, and it is determined at a step S253 whether or not the thus updated lower limit value KOBSVLML is larger than a lower guard value KOBSLMLD which is set according to the atmospheric pressure PA. If KOBSVLML>KOBSLMLD holds, the present routine is immediately terminated. On the other hand, if KOBSVLML≦KOBSLMLD holds, the lower limit value KOBSVLML is set to the lower guard value KOBSLMLD at a step S254, followed by terminating the present routine.

Figure 13:
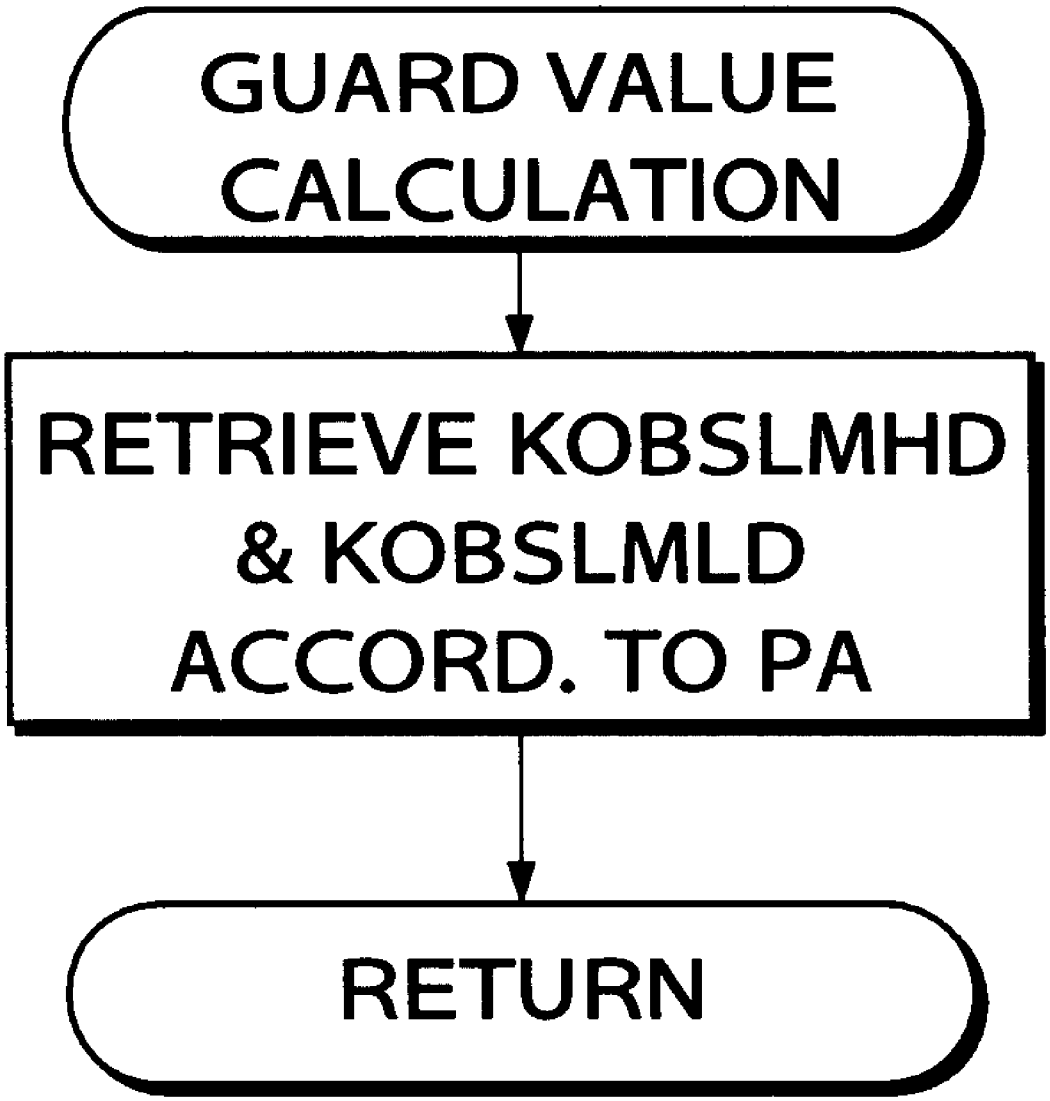
FIG. 13 is a flowchart showing a subroutine for determining upper and lower guard values KOBSLMHD and KOBSLMLD which are employed in the FIG. 10 subroutine.
Figure 15B:
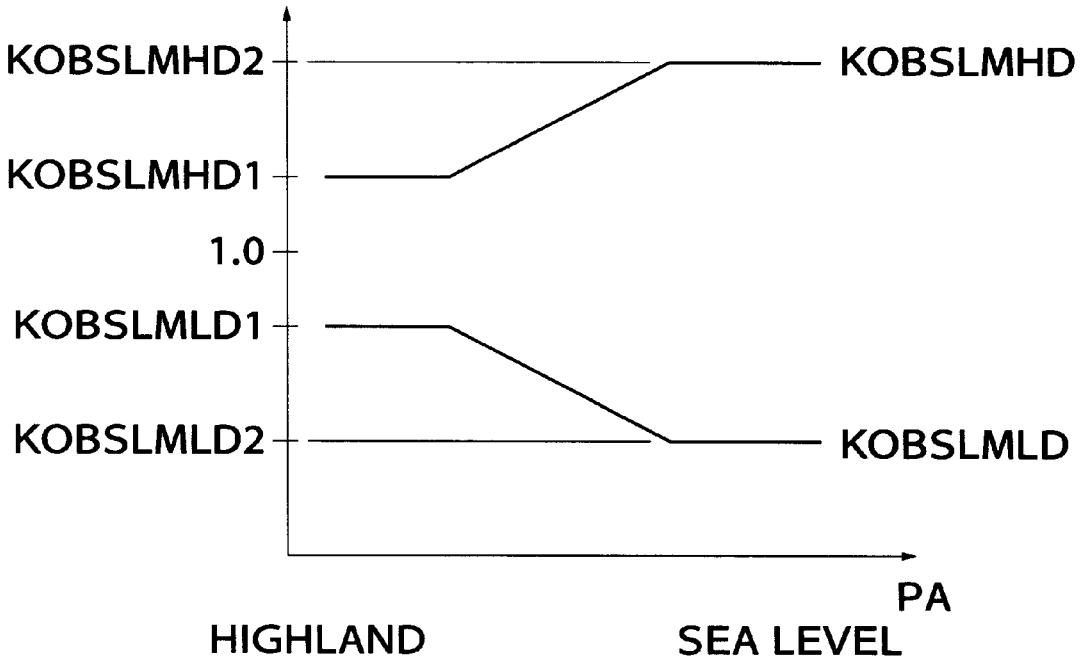
FIG. 15B shows a table for determining the upper and lower guard values KOBSLMHD and KOBSLMLD according to atmospheric pressure PA.

The upper guard value KOBSLMHD and the lower guard value KOBSLMLD are determined through a guard value calculation, shown in FIG. 13 (by background processing, which is executed when no process synchronous with generation of TDC signal pulses is executed) by retrieving a guard value table shown in FIG. 15B. The guard value table is set such that table values of the upper guard value KOBSLMHD decrease and those of the lower guard value KOBSLMLD increase as the atmospheric pressure PA decreases, i.e. the allowable range of the cylinder-by-cylinder air-fuel ratio correction coefficient KOBSV#N defined by the upper and lower limit values KOBSVLMH and KOBSVLML becomes narrower as the atmospheric pressure PA decreases. In FIG. 15B, predetermined values KOBSLMHD1 and KOBSLMHD2 are set to 1.02 and 1.05, respectively, while predetermined values KOBSLMLD1 and KOBSLMLD2 are set to 0.98 and 0.95, respectively.

By executing the steps S248 et seq., the upper limit value KOBSLMH is incremented and the lower limit value KOBSLML is decremented whenever the predetermined time period TDKOBSV elapses, whereby the allowable range of the cylinder-by-cylinder correction coefficient KOBSV#N is progressively expanded. Further, by executing the steps S242 to S244, when the rotational variation amount MEMF exceeds the threshold value MFJUDOBS and at the same time the cylinder-by-cylinder correction coefficient KOBSV#N of the present cylinder becomes smaller than the lean-side predetermined value KOBSVMFL, the upper and lower limit values KOBSVLMH and KOBSVLML are both reset to 1.0.

FIG. 11 shows a subroutine for calculating the KOBSV#N value, which is executed at the step S211 in FIG. 9.

First, at a step S271, the cylinder-by-cylinder air-fuel ratio is estimated in the aforedescribed method (i.e. calculating the estimated equivalent ratio KACT#N), and then at a step S272, the proportional term KPOB#N, the integral term KIOB#N, and the differential term KDOB#N of the cylinder-by-cylinder feedback control are calculated by the use of the equations (13A) to (13C). At the following steps S273 to S276, limit-checking of the integral term KIOB#N is carried out. More specifically, if the integral term KIOB#N is larger than an upper limit value KOBSVLMH, the integral term KIOB#N is set to the upper limit value KOBSVLMH at the steps S273 and S274, followed by the program proceeding to a step S283, whereas if the integral term KIOB#N is smaller than a lower limit value KOBSVLML, the integral term KIOB#N is set to the lower limit value KOBSVLML at the steps S275 and S276, followed by the program proceeding to a step S281. On the other hand, if the integral term KIOB#N is in a range between the upper and lower limit values KOBSVLMH and KOBSVLML, the program proceeds to a step S277.

At the step S277, the cylinder-by-cylinder correction coefficient KOBSV#N for the present cylinder is calculated by the use of the above equation (14), and at the following steps S278 to S283, the cylinder-by-cylinder correction coefficient KOBSV#N is limit-checked. More specifically, (1) if the cylinder-by-cylinder correction coefficient KOBSV#N is larger than the upper limit value KOBSVLMH, the integral term KIOB#N is set to a last value thereof KIOB#N(k−1) at the step S282 and at the same time the cylinder-by-cylinder correction coefficient KOBSV#N is set to the upper limit value KOBSVLMH at the step S283. (2) If the cylinder-by-cylinder correction coefficient KOBSV#N is smaller than the lower limit value KOBSVLML, the integral term KIOB#N is set to a last value of the same KIOB#N(k−1) at the step S280 and at the same time the cylinder-by-cylinder correction coefficient KOBSV#N is set to the lower limit value KOBSVLML at the step S281. (3) If the cylinder-by-cylinder correction coefficient KOBSV#N is in the range between the upper and lower limit values KOBSVLMH and KOBSVLML, the program is immediately terminated, i.e. the KIOB#N value and the KOBSV#N value is maintained as they are.

By executing the process of FIG. 11, the cylinder-by-cylinder correction coefficient KOBSV#N is calculated according to the estimated cylinder-by-cylinder equivalent ratio KACT#N, and the thus calculated cylinder-by-cylinder correction coefficient KOBSV#N and the integral term KIOB#N are limit-checked so as to fall within the range between the upper and lower limit values KOBSVLMH and KOBSVLML.

FIG. 12 shows a subroutine for calculating the learned value KOBSVR#Nj of the cylinder-by-cylinder correction coefficient KOBSV#N, which is executed at the step S212 in FIG. 9.

First, at a step S401, it is determined whether or not a predetermined time period has elapsed from a time point at which the cylinder-by-cylinder air-fuel ratio feedback control which is currently being executed was started (time point at which a state where the conditions for executing the cylinder-by-cylinder feedback control are unsatisfied shifted to a state where the conditions are satisfied). If the predetermined time period has not elapsed, the program is immediately terminated. On the other hand, if the predetermined time period has elapsed, the program proceeds to a step S402, wherein an equivalent ratio difference DKACTOB#N which is the difference between the actual equivalent ratio KACT(k) and the estimated cylinder-by-cylinder equivalent ratio KACT#N(k) is calculated by the use of the following equation (17):

$$DKACTOB\#N=KACT(k)-KACT\#N(k) \quad (17)$$

Then, it is determined at a step S403 whether or not the absolute value of the equivalent ratio difference |DKACTOB#N| is equal to or smaller than a predetermined value DKOBRFLM. If |DKACTOB#N |>DKOBRFLM holds, the program is immediately terminated without calculating the learned value KOBSVR#Nj.

On the other hand, if |DKACTOB#N|≦DKOBRFLM holds, the learned value KOBSVR#NJ is calculated for each of the three engine operating regions in the following manner, followed by terminating the present routine.

That is, if the intake pipe absolute pressure PBA is lower than a first predetermined value PBOBSRF1, a learned value KOBSVR#N1 is calculated by the use of the above equation (15) and the calculated value is stored in the back-up RAM at steps S404 and S406. If the intake pipe absolute pressure PBA is equal to or higher than the first predetermined value PBOBSRF1 and at the same time lower than a second predetermined value PBOBSRF2 (which is higher than the first predetermined value), a learned value KOBSVR#N2 is calculated by the use of the above equation (15) and the calculated value is stored in the back-up RAM at steps S404, S405 and S407. If the intake pipe absolute pressure PBA is equal to or higher than the second predetermined value PBOBSRF2, a learned value KOBSVR#N3 is calculated by the use of the above equation (15) and the calculated value is stored in the back-up RAM at steps S404, S405 and S408.

As described hereinabove, according to the present embodiment, if the rotational speed change amount MEMF is equal to or smaller than the predetermined threshold value MFJUDOBS, the allowable range between the upper and lower limit values KOBSVLMH and KOBSVLML is progressively expanded, whereas if the rotational speed change amount MEMF exceeds the threshold value MFJUDOBS and at the same time the cylinder-by-cylinder correction coefficient KOBSV#N for the present cylinder becomes smaller than the lean-side predetermined value KOBSVMFL, the upper and lower limit values KOBSVLMH and KOBSVLML are both set to 1.0. By this setting, the allowable range (upper and lower limit values) can be suitably set according to the rotational speed change amount MEMF of the engine. Further, the guard values KOBSLMHD and KOBSLMLD for the upper and lower limit values KOBSVLMH and KOBSVLML are set according to the atmospheric pressure PA. Therefore, the upper and lower limit values can be suitably set according to the altitude at which a vehicle in which the engine 1 is installed is traveling. As a result, variation in the exhaust gas flow rate which influences the accuracy of the estimated cylinder-by-cylinder air-fuel ratio is taken in to consideration, which leads to narrowing of the allowable range of the cylinder-by-cylinder air-fuel ratio upon increase in the rotational speed change amount or during traveling at high altitude when the estimation accuracy tends to be degraded, to thereby maintain stable control of the air-fuel ratio.

The present invention is not limitative to the embodiment as described above, but variations or modifications are possible. For example, the guard values KOBSLMHD and KOBSLMLD of the respective upper and lower limit values KOBSVLMH and KOBSVLML may be fixed values. Alternatively, instead of carrying out the expansion of the allowable range defined by the upper and lower limit values KOBSVLMH and KOBSVLML based on the rotational speed change amount MEMF (steps S247 to S254), the upper and lower limit values KOBSVLMH and KOBSVLML per se may be set so as to vary along curves similar to those shown in FIG. 15B, according to the atmospheric pressure PA.

What is claimed is:

1. In an air-fuel ratio control system for an internal combustion engine having a plurality of cylinders, and an exhaust system, including air-fuel ratio-detecting means arranged in said exhaust system, cylinder-by-cylinder air-fuel ratio-estimating means for estimating an air-fuel ratio of a mixture supplied to each of said cylinders cylinder by cylinder in response to an output from said air-fuel ratio-detecting means, by using an observer for observing an internal operative state of said exhaust system, based on a model representative of a behavior of said exhaust system, and cylinder-by-cylinder air-fuel ratio control means for calculating cylinder-by-cylinder air-fuel ratio control amounts corresponding respectively to said cylinders for carrying out feedback control of said air-fuel ratio of said mixture supplied to said each of said cylinders such that said estimated air-fuel ratio of said mixture supplied to said each of said cylinders is converged to a desired value, the improvement comprising:

limit-checking means for setting upper and lower limit values of said cylinder-by-cylinder air-fuel ratio control amounts according to at least one of an rotational speed change amount of said engine and atmospheric pressure, and for limiting said cylinder-by-cylinder air-fuel ratio control amounts so as to fall within an allowable range defined by said upper and lower limit values.

2. An air-fuel ratio control system as claimed in claim 1, wherein said limit-checking means sets said upper and lower limit values of said cylinder-by-cylinder air-fuel ratio control amounts such that said allowable range defined by said upper and lower limit values is progressively expanded, when said rotational speed change amount is equal to or smaller than a predetermined threshold value.

3. An air-fuel ratio control system as claimed in claim 2, wherein said limit-checking means sets said predetermined threshold value to a smaller value as at least one of rotational speed of said engine or load on said engine increases.

4. An air-fuel ratio control system as claimed in claim 2 or 3, wherein said limit-checking means sets said upper and lower limit values of said cylinder-by-cylinder air-fuel ratio control amounts to values such that said cylinder-by-cylinder air-fuel ratio control amounts all assume a non-corrective value, when said rotational speed change amount exceeds said predetermined threshold value and at the same time a present value of said cylinder-by-cylinder air-fuel ratio control amounts is smaller than a predetermined value leaner than a value corresponding to a stoichiometric air-fuel ratio.

5. An air-fuel ratio control system as claimed in any of claims 2 or 3, wherein said limit-checking means sets said allowable range defined by said upper and lower limit values to a narrower range as atmospheric pressure lowers.

* * * * *